US008875811B1

(12) United States Patent
Randa

(10) Patent No.: US 8,875,811 B1
(45) Date of Patent: Nov. 4, 2014

(54) JOINT WITH CHECK VALVE FOR A BORING APPARATUS

(75) Inventor: Mark D. Randa, Summit, WI (US)

(73) Assignee: Earth Tool Company, LLC, Oconomowoc, WI (US)

( * ) Notice: Subject to any disclaimer, the term of this patent is extended or adjusted under 35 U.S.C. 154(b) by 431 days.

(21) Appl. No.: 13/357,434

(22) Filed: Jan. 24, 2012

Related U.S. Application Data

(60) Provisional application No. 61/436,055, filed on Jan. 25, 2011.

(51) Int. Cl.
*E21B 21/10* (2006.01)

(52) U.S. Cl.
USPC ..... 175/318; 166/373; 166/374

(58) Field of Classification Search
CPC ..... E21B 21/10; E21B 21/00; E21B 34/10
USPC ..... 166/325, 319, 321, 332.1, 373, 386, 166/374; 175/61, 318, 339, 325.2, 62, 235, 175/317, 327, 406, 215, 331; 137/533, 137/533.31
See application file for complete search history.

(56) References Cited

U.S. PATENT DOCUMENTS 3,166,132 A * 1/1965 Lenahan et al. ..... 175/235
4,858,703 A * 8/1989 Kinnan ..... 175/19
2007/0278008 A1* 12/2007 Kuckes et al. ..... 175/40

* cited by examiner

*Primary Examiner* — Jennifer H Gay
*Assistant Examiner* — George Gray
(74) *Attorney, Agent, or Firm* — Tomlinson Rust McKinstry Grable

(57) ABSTRACT

A check valve for a drill string fluid delivery system. The fluid delivery system allows for drilling mud to travel from a source up the drill string, through the drill string, through a downhole tool assembly, to a port located at a surface of a boring tool. The check valve rests in a socket within the downhole tool assembly, with a forward face extending into a gallery within the bit. When the ambient pressure within the fluid delivery system exceeds the ambient pressure in the borehole, mud flows through the system to the ports and into the borehole. When the ambient pressure within the borehole exceeds the ambient pressure in the fluid delivery system, the pressure is applied to the forward face, causing the check valve to close, preventing contaminants from the borehole from entering the fluid delivery system.

16 Claims, 3 Drawing Sheets

JOINT WITH CHECK VALVE FOR A BORING APPARATUS

CROSS REFERENCE TO RELATED APPLICATION

This application claims the benefit of provisional patent application Ser. No. 61/436,055 filed on Jan. 25, 2011, the entire contents of which are incorporated herein by reference.

FIELD OF THE INVENTION

The invention relates to directional boring, in particular to a directional boring system wherein drilling fluid is delivered to the boring head through a check valve to prevent backflow into the drill string.

SUMMARY OF THE INVENTION

The present invention is directed to a fluid delivery system for a boring tool and a downhole tool assembly for use with a drill string. The system comprises a central bore within the downhole tool assembly, at least one external port formed in the boring tool, a bit gallery, a socket, and a plunger. The bit gallery is formed in the boring tool in fluid communication with the at least one external port. The socket is formed in an end of the downhole tool assembly in fluid communication with the central bore and adjacent to the bit gallery. The plunger is located within the socket and moveable between a first and second position. The bit gallery abuts the plunger when the plunger is in the second position. The plunger prevents fluid communication between the socket and the at least one external port when in the first position. The plunger allows fluid communication between the socket and the at least one external port when in the second position.

Another embodiment of the invention is directed to a check valve for use with a fluid delivery system. The fluid delivery system is adapted to transport fluid from a drill string to a boring tool and a downhole tool assembly. The boring tool comprises at least one external port for expulsion of fluids from the fluid delivery system. The check valve comprises a socket, a bit gallery, and a plunger. The socket is formed in the downhole tool assembly and is in fluid communication with the drill string. The bit gallery is formed in the boring tool and is in fluid communication with the at least one external port. The plunger comprises a first end and a second end. The second end is slidably receivable within the socket. The plunger is moveable between a first position and a second position. The socket is separated from the gallery when the plunger is in the first position and the socket is in fluid communication with the gallery when the plunger is in the second position.

Yet another embodiment of the invention is directed to a method for preventing backflow into a fluid delivery system. The fluid delivery system is located within a boring tool and a downhole tool assembly provided on a drill string. The fluid delivery system comprises at least one external port located on the boring tool, a central bore located within the tool assembly and a socket located at an end of the tool assembly proximate the boring tool. The method comprises providing a plunger within the socket, providing fluid to the fluid delivery system, and moving the plunger to a first position within the socket with the provided fluid such that the at least one external port is in fluid communication with the central bore. The method further comprises discontinuing fluid flow such that ambient pressure about the drilling tool is greater than the pressure within the central bore and moving the plunger to a second position within the socket due to the pressure differential such that the at least one external port is not in fluid communication with the central bore.

DESCRIPTION OF THE PREFERRED EMBODIMENT

Horizontal directional drilling operations allow for the trenchless installation and removal of utility lines and pipes, minimizing surface disruption associated with traditional trenching techniques. In these operations, drilling fluid or mud is helpful to soften the soil or rock in the path of a drill bit. Drilling fluid is often transported down the drill string to the bit through an internal fluid delivery system. The pressure within the fluid delivery system is greater than the ambient pressure in the borehole, causing the fluid to flow out of the drill string and into the borehole. However, as a drill bit progresses, sections of drill string must be added or removed. During this addition or removal, the fluid delivery system shuts down. When the fluid delivery system is inactive, the ambient pressure in the borehole exceeds that within the fluid delivery system, causing contaminants in the borehole such as drilling fluid mixed with soil, rock, metal shavings, etc. to enter the fluid delivery system. This can cause damage to internal components within the drill string. The method and apparatus below is advantageous in alleviating this problem.

Figure 1:
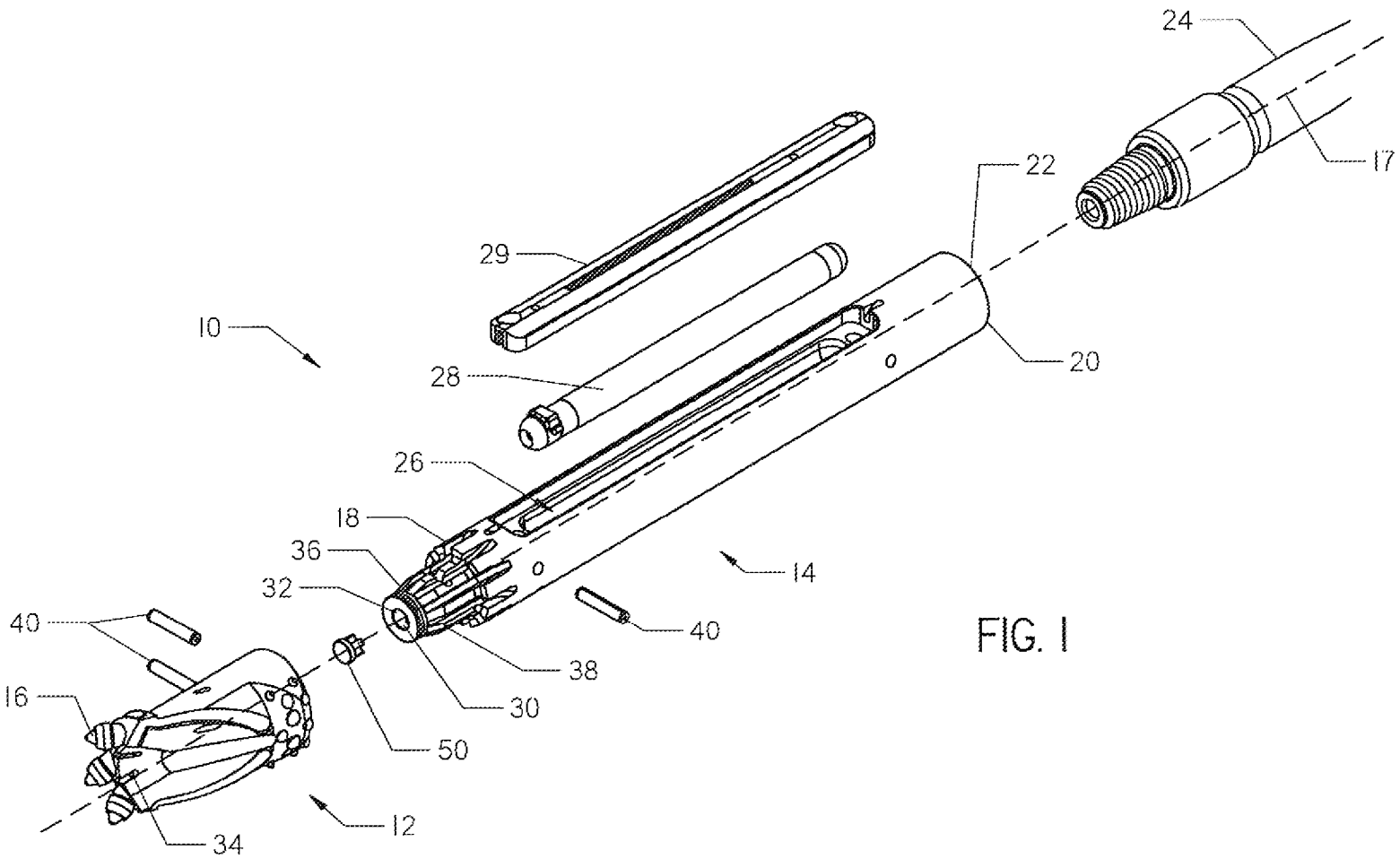
FIG. 1 is an exploded isometric view of a steerable rock drilling head with a coupling mounting a bit and an integrated flow check valve.

With reference to the figures in general and FIG. 1 in particular, shown therein is a downhole tool 10. The downhole tool comprises a boring head 12, such as a drill bit (as shown) or a backreamer, and a tool assembly 14. The boring head 12 comprises replaceable teeth 16 and is configured to drill a borehole in conjunction with horizontal direction drilling (HDD) operations. Other boring heads may be used with this apparatus, such as rotary cone bits, drag bits, and slant-faced directional bits. The tool assembly 14 comprises a central axis 17, a first end 18 and a second end 20, wherein the first end is connectable to the boring head 12 and the second end comprises an attachment point 22 for connection to a drill string 24. The tool assembly 14 comprises a cavity 26 for placement of an electronics package 28 such as a beacon. The beacon 28 is placed within the cavity 26 and enclosed by a cover 29. Preferably, the cover 29 is at least partially electronically transparent to allow for transmission of data from the beacon 28 to an above ground receiver (not shown).

The downhole tool 10 further comprises a mud delivery system 30 for delivery of drilling mud proximate the teeth 16 and boring head 12. Drilling mud promotes ease of drilling in both pilot drilling and backreaming processes. As shown, the mud delivery system 30 comprises a central bore 32 located within the tool assembly 14 and a number of ports 34 in the boring head in communication with the central bore. Drilling fluid, or drilling mud, is pumped from above-ground into the drill string 24, into the central bore 32, and finally distributed within the boring head 12 through the ports 34 and into the wellbore proximate the teeth 16.

The tool assembly 14 connects at its first end 18 to the boring head 12. The first end 18 comprises a stub end 36. As shown, the stub end 36 preferably comprises splines 38. The stub end 36 may alternatively comprise a geometric or threaded connection. The stub end 36 fits inside a cavity of the boring head 12 and is held in place by the use of pins 40.

During the boring operation drilling is stopped to allow drill string section addition or removal. During these changes, positive pressure in the mud delivery system 30 relative to the ambient pressure about the boring head 12 in the bore reverses. During this time period contaminated drill fluid, bentonite, polymer or ground water mixed with the cuttings from the rock or soil in the bore flow may back into the ground engagement apparatus 10. The ports 34 may preferably comprise nozzles of reduced cross sectional flow area for purposes of accelerating the mud velocity on discharge. As a result these nozzles are prone to clogging when solids are introduced into the drill fluid upstream of the nozzle. As the ports 34 are externally located and prone to abrasive wear, a valve or cover located at the port is impractical.

With continued reference to FIG. 1, a check valve 50 for use with the present invention is shown. The check valve 50 is located in the central bore 32 at the first end 18 of the tool assembly 14. The central bore 32 is preferably on or near the central axis 17 of tool assembly 14 and within the stub end 36. This position for the check valve 50 is regularly made accessible for servicing and cleaning when swapping the beacon 28 or the boring head 12.

Figure 2:
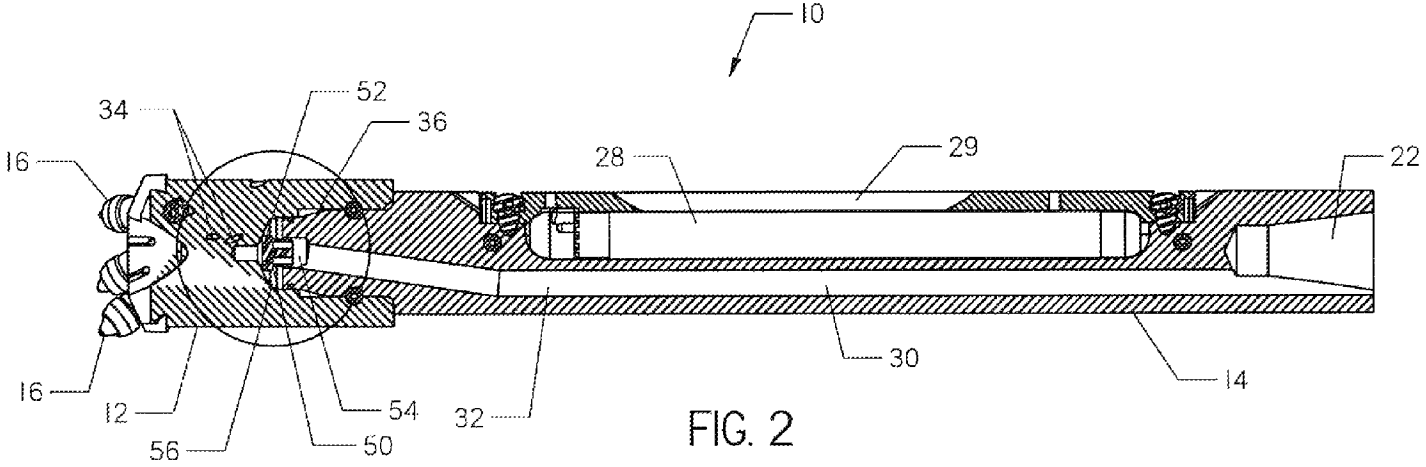
FIG. 2 is a sectional side view of the apparatus of FIG. 1.

With reference now to FIG. 2, an internal view of the downhole tool 10 is shown. The check valve 50 comprises a plunger 52 and a plunger socket 54 and a gallery 56. The plunger socket 54 is located at a terminal end of the central bore 32 of the mud delivery system 30 at the first end 18 of the tool assembly 14. The plunger socket 54 is adapted to slidably receive the plunger 52. The gallery 56 is formed within the boring head 12 and a part of the mud delivery system 30. The gallery 56 is formed to allow a portion of the plunger 52 to move within the gallery. The gallery is adapted to receive mud from the central bore 32 and allow its transmission to the ports 34 at the surface of the boring head 12. At the second end 20 of the tool assembly 14, the central bore 32 is adapted to receive drilling mud from the drill string 24 (FIG. 1) when attached to the ground engagement apparatus 10.

Figure 3:
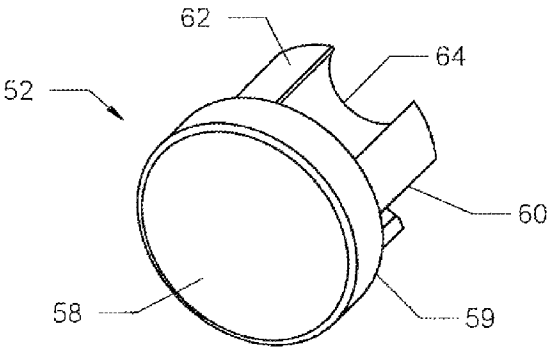
FIG. 3 is an isometric view of the check valve plunger of FIG. 1.

With reference now to FIG. 3, the plunger 52 of FIGS. 1 and 2 is shown in more detail. The plunger 52 comprises a forward face 58, a rearward face 59, and a pilot area 60. The forward face 58 functions as the travel limit such that the forward face will contact a wall of the gallery 56 to prevent undesired movement within the check valve 52. The pilot area 60 comprises a land 62 and longitudinal grooves 64. The land 62 is sized to fit within the plunger socket 54 and facilitate smooth and reliable axial motion of the plunger. The longitudinal grooves 62 permit flow of mud past the plunger 52.

Figure 4A:
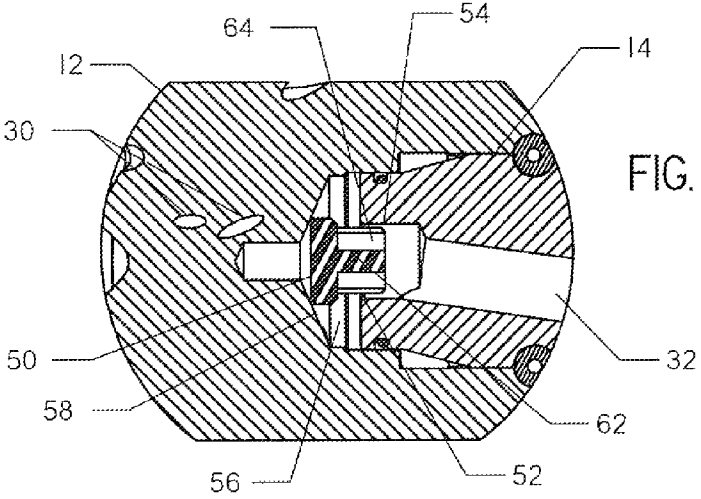
FIG. 4*a* a sectional side view of the check valve in an open position.
Figure 4B:
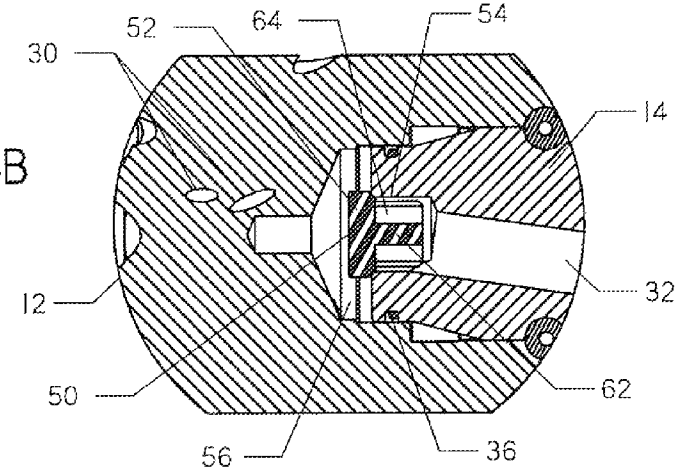
FIG. 4*b* is a sectional side view of the check valve in a closed position.

With reference now to FIGS. 4*a* and 4*b*, the check valve 50 is shown in its two modes of operation. With reference to FIG. 4*a*, the check valve 50 is shown when the pressure within the mud delivery system 30 exceeds the ambient pressure outside the boring tool 10. In this mode, the mud pushes the plunger 52 from the plunger socket 54 to an open position. Mud is allowed to travel through the longitudinal grooves 64 and into the gallery 56. Mud entering the gallery 56 flows to the ports 34 and out of the boring head 12 for drilling or backreaming operations. As shown, the forward face 58 is contacting the boring head 12 within the gallery 56, and thus is at one limit of its travel in the axial direction.

With reference to FIG. 4*b*, the check valve 50 is shown when the pressure within the mud delivery system 30 is less than the ambient pressure outside the downhole tool 10 (FIG. 1), such as when sections of drill string 24 are being added removed. As shown, the rearward face 59 (FIG. 3) of the plunger 52 is contacting the stub end 36. Thus, the plunger is cutting off fluid flow from the gallery 56 from the plunger socket 54 and undesirable liquids entering the gallery are prevented from entering the central bore 32 and the rest of the upstream mud delivery system 30.

Various modifications can be made in the design and operation of the present invention without departing from the spirit thereof. Thus, while the principal preferred construction and modes of operation of the invention have been explained in what is now considered to represent its best embodiments, as herein illustrated and described, it should be understood that the invention may be practiced otherwise than as specifically illustrated and described.

What is claimed:

1. A fluid delivery system for a boring tool and a downhole tool assembly for use with a drill string, the system comprising:

a central bore within the downhole tool assembly;

at least one external port formed in the boring tool;

a bit gallery formed in the boring tool in fluid communication with the at least one external port;

a socket formed in an end of the downhole tool assembly in fluid communication with the central bore and adjacent to the bit gallery; and a plunger located within the socket moveable between a first and second position such that the bit gallery abuts the plunger when the plunger is in the second position;

wherein the plunger prevents fluid communication between the socket and the at least one external port when in the first position and allows fluid communication between the socket and the at least one external port when in the second position;

wherein the boring tool comprises a rotating drill bit.

2. The fluid delivery system of claim 1 wherein the boring tool comprises a rotary cone bit.

3. The fluid delivery system of claim 1 wherein the boring tool comprises a slant-faced bit.

4. The fluid delivery system of claim 1 wherein the downhole tool assembly comprises a beacon.

5. The fluid delivery system of claim 1 wherein the plunger comprises at least one longitudinal groove.

6. The fluid delivery system of claim 1 wherein the plunger moves axially relative to the downhole tool assembly in response to a movement of fluid through the central bore.

7. A check valve for use with a fluid delivery system, wherein the fluid delivery system is adapted to transport fluid from a drill string to a rotating drill bit and a downhole tool assembly, the rotating drill bit comprising at least one external port for expulsion of fluids from the fluid delivery system, the check valve comprising:

a socket formed in the downhole tool assembly in fluid communication with the drill string;

a bit gallery formed in the rotating drill bit in fluid communication with the at least one external port; and a plunger comprising a first end and a second end, wherein the second end is slidably receivable within the socket;

wherein the plunger is moveable between a first position and a second position such that the socket is separated from the gallery when the plunger is in the first position and the socket is in fluid communication with the gallery when the plunger is in the second position.

8. The valve of claim 7 wherein the first end of the plunger abuts the bit gallery when in the second position.

9. The valve of claim 7 wherein the plunger moves from the first position to the second position upon a movement of fluid through the fluid delivery system.

10. The valve of claim 9 wherein the plunger moves from the second position to the first position upon termination of the movement of fluid through the fluid delivery system.

11. The valve of claim 9 wherein the plunger comprises:

a forward face to contact the bit gallery when the plunger is in the second position;

a rearward face to contact the downhole tool assembly when the plunger is in the first position; and a pilot area extending from the rearward face and disposed within the socket comprising at least one longitudinal groove.

12. The valve of claim 7 wherein the rotating boring tool comprises a rotary cone bit.

13. The valve of claim 7 wherein the rotating boring tool comprises a slant-faced bit.

14. A method for preventing backflow into a fluid delivery system, the fluid delivery system located within a rotating drill bit and a downhole tool assembly provided on a drill string, wherein the fluid delivery system comprises at least one external port located on the boring tool, a central bore located within the tool assembly and a socket located at an end of the tool assembly proximate the rotating drill bit, the method comprising:

providing a plunger within the socket in a first position;

providing fluid to the fluid delivery system;

drilling with the rotating drill bit;

moving the plunger to a second position within the socket with the provided fluid such that the at least one external port is in fluid communication with the central bore;

discontinuing fluid flow such that ambient pressure about the drilling tool is greater than the pressure within the central bore; and moving the plunger to the first position within the socket due to the pressure differential such that the at least one external port is not in fluid communication with the central bore.

15. The method of claim 14 further wherein the rotating drill bit comprises a bit gallery.

16. The method of claim 15 further comprising the step of causing the plunger to abut the bit gallery when the plunger is in the second position.

* * * * *